US008827407B2

(12) United States Patent
Ogawa

(10) Patent No.: US 8,827,407 B2
(45) Date of Patent: Sep. 9, 2014

(54) PRINTING SYSTEM

(71) Applicant: Riso Kagaku Corporation, Tokyo (JP)

(72) Inventor: Hideaki Ogawa, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/868,761

(22) Filed: Apr. 23, 2013

(65) Prior Publication Data

US 2013/0286076 A1 Oct. 31, 2013

(30) Foreign Application Priority Data

Apr. 26, 2012 (JP) ..... 2012-100642

(51) Int. Cl.
*B41J 29/38* (2006.01)
*B41J 11/00* (2006.01)

(52) U.S. Cl.
CPC ..... *B41J 11/006* (2013.01)
USPC ..... 347/16

(58) Field of Classification Search
CPC ..... B41J 11/006
See application file for complete search history.

(56) References Cited

U.S. PATENT DOCUMENTS

| | | | | |
|---|---|---|---|---|
| 8,020,959 | B2 * | 9/2011 | Yamashiro et al. | 347/16 |
| 2012/0230747 | A1 * | 9/2012 | Cole et al. | 400/582 |
| 2012/0248694 | A1 * | 10/2012 | Cheng | 271/279 |

FOREIGN PATENT DOCUMENTS

JP 09-040272 A 2/1997

* cited by examiner

*Primary Examiner* — Jason Uhlenhake
(74) *Attorney, Agent, or Firm* — Studebaker & Brackett PC

(57) ABSTRACT

A printing system includes: a printing unit; a post-processing unit for performing predetermined post-processing on printed printing paper sheets ejected from the printing unit; a priority setting section, in which a priority of removal of a cause of suspension among the units when operations of each unit are suspended due to a predetermined cause is set in advance; and an informing section for informing the user to remove the cause of suspension according to the priority set in the priority setting section.

5 Claims, 6 Drawing Sheets a

| INK TEMPERATURE | TIME TAKEN FOR PREPARATION OPERATION |
|---|---|
| LESS THAN x1°C | T1 |
| NOT LESS THAN x1°C AND LESS THAN x2°C | T2 |
| NOT LESS THAN x2°C | T3 |

b

| GLUE TEMPERATURE | TIME TAKEN FOR PREPARATION OPERATION |
|---|---|
| LESS THAN y1°C | t1 |
| NOT LESS THAN y1°C AND LESS THAN y2°C | t2 |
| NOT LESS THAN y2°C | t3 |

PRINTING SYSTEM

BACKGROUND OF THE INVENTION

1. Field of the Invention

The present invention relates to a printing system including a printing unit and a post-processing unit, etc., connected to the printing unit, and in particular to a procedure of removal of causes of suspension of the individual units.

2. Description of the Related Art

Conventionally, various printing systems that include a printing unit for performing a printing process and a post-processing unit and/or a pre-processing unit connected to the printing unit are proposed.

Examples of the post-processing unit connected to the printing unit may include: a bookbinding unit, which performs case binding using printing paper sheets subjected to printing at the printing unit; an enclosing/sealing unit, which makes an envelope using a printing paper sheet subjected to printing and encloses and seals an inner paper sheet (letter) in the envelope to form a sealed letter; a stapler unit, which staples a bundle of printing paper sheets subjected to printing, etc. An example of the pre-processing unit may include a high capacity feeder unit, which is capable of feeding a large amount of printing paper sheets to the printing unit.

When paper jam occurs at the post-processing unit, for example, in the printing system including the units as described above, operations of the post-processing unit are suspended, and operations of the printing unit and the pre-processing unit are also suspended. With respect to the printing unit and the pre-processing unit, if paper jam also occurs at these units along with the paper jam at the post-processing unit, operations of the printing unit and the pre-processing unit are naturally suspended. However, the operations of the printing unit and the pre-processing unit are suspended even when no paper jam occurs at these units since the operations of the post-processing unit cannot be proceeded.

Then, causes of suspension at these units are removed by removing the paper jam at the post-processing unit, and removing printing paper sheets left on the conveyance path in the printing unit and/or the pre-processing unit.

On the other hand, when the operations of the units in the printing system are suspended, as described above, it is necessary to perform a preparation operation (warming-up operation), which is unique to each unit, after the cause of suspension at each unit is removed and before the system is recovered to start the next cycle of normal operation. The preparation operation begins at the point of time when the cause of suspension at each unit is removed.

SUMMARY OF THE INVENTION

Since the preparation operation of each unit is unique to each unit, as mentioned above, the time taken for the preparation operation varies among the different units.

Therefore, if, for example, the cause of suspension is removed first from a unit whose preparation operation takes a relatively short time before the cause of suspension at a unit whose preparation operation takes a relatively long time is removed, the time taken for completing the preparation operations of all the units, i.e., the downtime of the system will be longer, resulting in lower productivity.

Japanese Unexamined Patent Publication No. 1-109 (1997)-40272 (hereinafter, Patent Document 1) discloses a printing system including a printing unit and a bookbinding unit, where, even when paper jam occurs at the printing unit, the preparation operation of the bookbinding unit is continued, thereby reducing the recovery time. However, Patent Document 1 proposes nothing about a method of recovery that is used when operations of the units forming the printing system are suspended all at once, as described above.

In view of the above-described circumstances, the present invention is directed to providing a printing system which allows reduction of downtime of the system when operations of units forming the printing system are suspended, thereby improving productivity.

An aspect of the printing system of the invention includes: a printing unit for performing printing on printing paper sheets; at least one of a post-processing unit for performing predetermined post-processing on printed printing paper sheets ejected from the printing unit and a pre-processing unit connected to the upstream side of the printing unit; a priority setting section, in which a priority of removal of a cause of suspension among the units when operations of each unit are suspended due to a predetermined cause is set in advance; and an informing section for informing the user to remove the cause of suspension according to the priority set in the priority setting section.

The printing system of the invention may include the post-processing unit, and the priority set in the priority setting section may be set such that the removal of the cause of suspension at the post-processing unit is performed prior to the removal of the cause of suspension at the printing unit.

The priority setting section may obtain information about the time taken for a preparation operation of each unit that is performed after the removal of the cause of suspension and before restarting of a normal operation, and may set the priority based on the obtained information.

The printing system may include a preparation operation time measuring section for measuring the time taken for the preparation operation of each unit, wherein the priority setting section may obtain the time taken for the preparation operation of each unit measured by the preparation operation time measuring section and may set the priority based on the obtained time taken for the preparation operation.

The printing system may include a priority settings receiving section for receiving an input of settings of the priority by the user.

According to the printing system of the invention, the priority of removal of a cause of suspension among the units is set in advance, and when operations of each unit are suspended due to a predetermined cause, the user is informed to remove the cause of suspension according to the priority. As the user removes the cause of suspension at each unit according to the priority, the cause of suspension at a unit whose preparation operation takes a relatively long time can be removed first, thereby allowing reduction of the downtime of the system and improving the productivity.

Specifically, in a case where a case binding unit is used as the post-processing unit, for example, the preparation operation of the case binding unit includes an operation of heating glue, which usually takes a longer time than the preparation operation of the printing unit. Therefore, by setting the priority such that the removal of the cause of suspension at the case binding unit is performed prior to the removal of the cause of suspension at the printing unit, the preparation operation of the case binding unit can be started earlier than the preparation operation of the printing unit, thereby allowing reduction of the downtime of the system and improving the productivity.

Further, in the case where the information about the time taken for the preparation operation of each unit that is performed after the removal of the cause of suspension and before restarting of the normal operation is obtained and the priority is set based on the obtained information, the priority can be set based on the information about the time taken for the preparation operation of each unit even when there are two or more types of post-processing units and/or pre-processing units connected to the printing unit, for example, and the preparation operations of the individual units can be started in an appropriate order.

Still further, in the case where the time taken for the preparation operation of each unit is actually measured at the unit and the priority is set based on the measured time taken for the preparation operation of each unit, the time taken for the preparation operation of each unit can be obtained by actual measurement even when a new pre-processing unit or post-processing unit is connected to the printing unit, for example, and an appropriate priority can be set depending on the time taken for the preparation operation of the unit.

Yet further, in the case where the priority of removal of the cause of suspension is set according to an input of settings by the user, the priority can be set not only in view of improving the production efficiency, for example, but also in view of other needs of the user.

DESCRIPTION OF THE PREFERRED EMBODIMENTS

Figure 1:
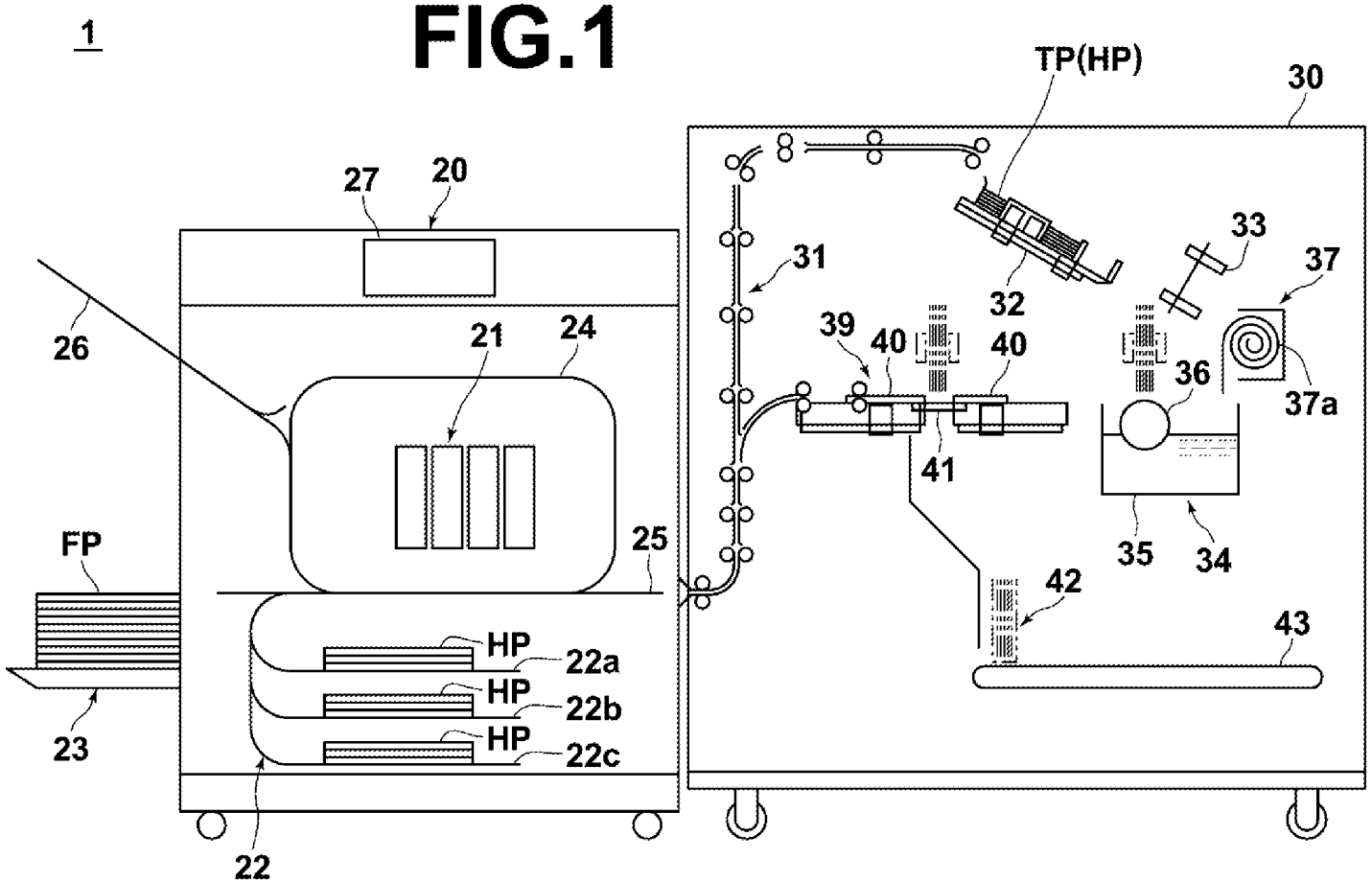
FIG. 1 is a schematic structural diagram illustrating the entire printing system according to one embodiment of the present invention.

Hereinafter, a printing system according to one embodiment of the present invention will be described in detail with reference to the drawings. The printing system of this embodiment is characterized by a procedure of removal of causes of suspension at a printing unit and a bookbinding unit, which form the printing system. First, the entire structure of the printing system is described. FIG. 1 is a schematic structural diagram illustrating the entire printing system 1 of this embodiment.

As shown in FIG. 1, the printing system 1 of this embodiment includes a printing unit 20, which performs printing on printing paper sheets for covers and printing paper sheets for pages used for case binding, and a bookbinding unit 30, which performs case binding using the printing paper sheets subjected to printing at the printing unit 20.

The printing unit 20 includes an ink head section 21, which ejects ink onto the printing paper sheets. The ink head section 21 achieves printing by ejecting ink onto the printing paper sheets based on image data of the pages and the cover inputted to the printing unit 20. The ink head section 21 of this embodiment includes a plurality of line-type ink heads for ejecting inks of different colors, such as black K, cyan C, magenta M and yellow Y.

The printing unit 20 also includes a paper feeding tray 22, on which printing paper sheets HP for pages are placed, and a straight paper feeding tray 23, on which printing paper sheets FP for covers are placed. The paper feeding tray 22 includes a first paper feeding tray 22*a*, a second paper feeding tray 22*b* and a third paper feeding tray 22*c* for holding the printing paper sheets HP for pages of different types and/or sizes. When case-bound books are produced, the printing paper sheets FP for covers and the printing paper sheets HP for pages are picked up and fed one by one by paper feeding rollers (not shown), or the like, from the straight paper feeding tray 23 and the paper feeding tray 22, respectively.

The printing unit 20 includes a circulating conveyance path 24 for conveying the printing paper sheets FP for covers and the printing paper sheets HP for pages. The circulating conveyance path 24 conveys the printing paper sheets FP for covers, which are fed from the straight paper feeding tray 23, and the printing paper sheets HP for pages, which are fed from the paper feeding tray 22, from the upstream side to the downstream side of the ink head section 21.

In the case of simplex printing, the circulating conveyance path 24 passes the printing paper sheets subjected to printing at the ink head section 21 to a connecting conveyance path 25. In the case of duplex printing, the circulating conveyance path 24 conveys the printing paper sheets with one faces thereof subjected to printing to an inverting section 26, and conveys the printing paper sheets which are inverted at the inverting section 26 again from the upstream side to the downstream side of the ink head section 21. Thereafter, the circulating conveyance path 24 passes the printing paper sheets with the other faces thereof subjected to printing at the ink head section 21 (and thus the opposite faces thereof subjected to printing) to the connecting conveyance path 25. Then, the printed printing paper sheets received by the connecting conveyance path 25 are fed to the bookbinding unit 30.

The printing unit 20 also includes a touch panel 27, which displays a predetermined setting input screen and receives a predetermined input of setting by the user. The touch panel 27 in this embodiment presents to the user an order of removal of causes of suspension at the printing unit 20 and the bookbinding unit 30 when, for example, paper jam occurs at the bookbinding unit 30 and operations of the printing unit 20 and the bookbinding unit 30 are suspended. How the order of removal of causes of suspension is displayed will be described in detail later.

The bookbinding unit 30 includes a paper conveyance path 31 for conveying the printing paper sheets FP for covers and the printing paper sheets HP for pages fed from the connecting conveyance path 25 of the printing unit 20. The paper conveyance path 31 conveys the printing paper sheets HP for pages to an aligning tray 32, and conveys the printing paper sheets FP for covers to a shaping section 39. It should be noted that the paper conveyance path 31 includes a mechanism (not shown) for switching between a conveyance path leading to the aligning tray 32 and a conveyance path leading to the shaping section 39.

On the aligning tray 32, the printing paper sheets HP for pages conveyed by the paper conveyance path 31 are sequentially stacked. The bookbinding unit 30 includes a clamper 33 for receiving and clamping a bundle TP of the printing paper sheets HP for pages from the aligning tray 32. The clamper 33 is adapted to be movable between a bundle receiving position, where the clamper 33 receives the bundle TP from the aligning tray 32, and a binding position, where the clamper 33 passes the bundle TP to the shaping section 39, by a moving mechanism (not shown).

A gluing section 34 is disposed in the vicinity of the clamper 33. The gluing section 34 includes: a glue storing vessel 35 for storing a glue, which is used to adhere the bundle TP to the printing paper sheet FP for cover; a glue application roller 36 for applying the glue to the bundle TP; and a glue replenishing section 37 for replenishing the glue storing vessel 35 with the glue.

The glue storing vessel 35 stores the glue in the vessel, and the vessel is provided with a heater (not shown) for heating the vessel to a temperature at which the glue liquefies.

The glue application roller 36 has an elongated shape, and is rotatably held in the glue storing vessel 35 by a horizontal rotating shaft. It should be noted that the glue also serves to integrally hold the bundle TP.

The glue replenishing section 37 includes a glue roll 37*a*, which is a rolled sheet of solid glue. Based on a control signal from a control section 50, which will be described later, of the bookbinding unit 30, the sheet of solid glue is unwound from the glue roll 37*a* and cut, and the cut piece of solid glue is fed to the glue storing vessel 35, thereby replenishing the glue storing vessel 35 with the glue. The sheet of solid glue unwound from the glue roll 37*a* and cut is heated by the heater at the glue storing vessel 35 to liquefy, and is stored in the glue storing vessel 35.

The shaping section 39 includes a cover folding plate 40 and an abutting plate 41 disposed below the cover folding plate 40. Each printing paper sheet FP for cover conveyed by the paper conveyance path 31 is placed on the top surface of the cover folding plate 40, and the spine of each bundle TP conveyed by the clamper 33 to the binding position is abutted on the abutting plate 41 via the printing paper sheet FP for cover.

The bookbinding unit 30 also includes a discharging section 43. Each book 42, which has been bound and shaped at the shaping section 39, is conveyed to and placed at the discharging section 43. The conveyance of the book 42 from the shaping section 39 to the discharging section 43 is achieved by free fall.

The schematic structure of the entire printing system 1 of this embodiment is as described above.

Next, a control system of the printing system 1 of this embodiment is described with reference to FIG. 2. As mentioned above, the printing system 1 of this embodiment is characterized by the procedure of removal of causes of suspension at the printing unit 20 and the bookbinding unit 30 forming the printing system, and therefore the control system relating to this feature is mainly described.

Figure 2:
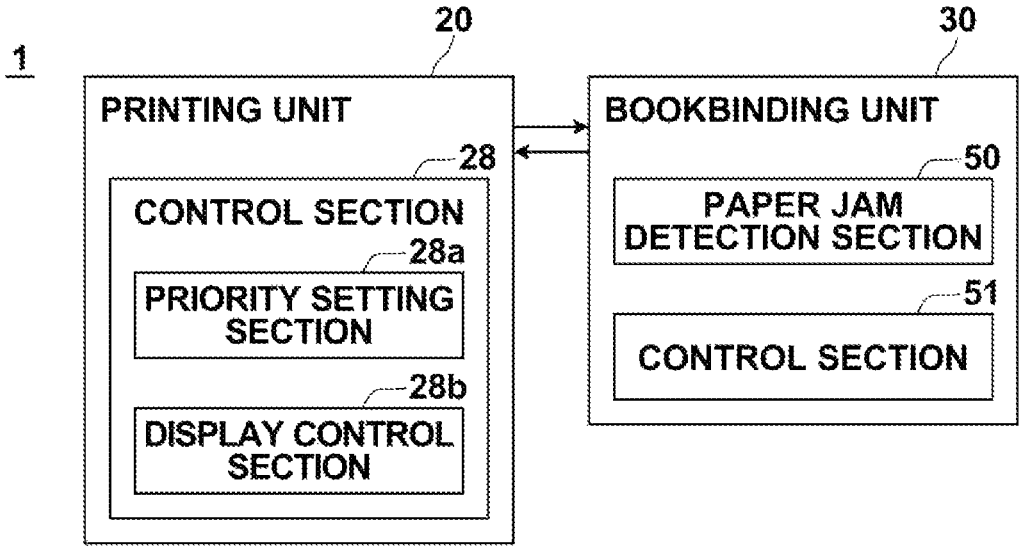
FIG. 2 is a block diagram illustrating the schematic configuration of a printing unit and a bookbinding unit of the printing system shown in FIG. 1.

As shown in FIG. 2, the printing unit 20 includes a control section 28 for controlling the entire printing unit 20. When paper jam is detected at the bookbinding unit 30, the control section 28 suspends the printing operation of the printing unit 20 along with the suspension of the operation of the bookbinding unit 30.

The control section 28 includes: a priority setting section 28*a*, in which a priority of removal of a cause of suspension when paper jam is detected at the bookbinding unit 30 and the operations of the bookbinding unit 30 and the printing unit 20 are suspended, as described above, is set in advance; and a display control section 28*b*, which causes the touch panel 27 to display a screen for prompting the user to remove the causes of suspension according to the priority set in the priority setting section 28*a*.

As shown in FIG. 2, the bookbinding unit 30 includes a control section 51 for controlling the entire bookbinding unit 30. The bookbinding unit 30 also includes a paper jam detection section 50 for detecting paper jam occurring at the bookbinding unit 30. The paper jam detection section 50 includes optical sensors, or the like, provided along the conveyance path for the printing paper sheets in the bookbinding unit 30. Such a configuration of the paper jam detection section 50 has already been known and a detailed description thereof is omitted. When paper jam is detected by the paper jam detection section 50, a paper jam detection signal is inputted to the control section 51. Then, the control section 51 suspends the binding operation of the bookbinding unit 30 in response to the paper jam detection signal.

Now, the priority set in advance in the priority setting section 28*a* of the printing unit 20 is described. The priority set in advance in the priority setting section 28*a* of this embodiment is set such that the removal of the cause of suspension at the bookbinding unit 30 is performed prior to the removal of the cause of suspension at the printing unit 20.

This is because that, when both the operations of the printing unit 20 and the bookbinding unit 30 are suspended as described above, it is necessary to perform a preparation operation (warming-up operation) after the suspension is cancelled and before the normal operation is restarted, and the preparation operation of the bookbinding unit 30 takes longer time than the preparation operation of the printing unit 20.

The preparation operation of the bookbinding unit 30 includes, for example: an operation of no-load running of rollers of the conveyance system for conveying the printing paper sheets after the user has removed printing paper sheets which caused the paper jam; an operation of moving each actuator with a home position sensor (such as the cover folding plate 40 of the shaping section 39, a vertical edge alignment fence and a horizontal edge alignment fence of the aligning tray 32, etc.) to the home position thereof; an operation of heating the glue stored in the glue storing vessel 35 to a temperature of 155° C.; and an operation of stirring the heated glue. Among these operations in the preparation operation of the bookbinding unit 30, the operation of heating the glue takes the longest time of about 17 minutes. The preparation operation of the bookbinding unit 30 is controlled by the control section 51 of the bookbinding unit 30.

On the other hand, the preparation operation of the printing unit 20 includes, for example: an operation of no-load running of rollers of the conveyance system for conveying the printing paper sheets; an operation of cleaning the heads of the ink head section 21; and an operation of circulating the inks. The operation of cleaning the heads is performed for preventing ink clogging at the ink head section 21, and specifically involves ejecting the inks several times from the ink head section 21. The operation of circulating the inks is performed for keeping the viscosity of the inks constant by circulating the inks in an ink circulation path section and for keeping the ink temperature within an appropriate temperature range that allows printing quality above a certain level. The ink head section 21 includes an ink temperature controlling section (not shown), which includes the ink circulation path section as well as a heater and a cooler. During the operation of circulating the inks, the inks are circulated in the ink circulation path section and the circulating inks are heated with the heater or cooled with the cooler, thereby controlling the ink temperature to be within the appropriate temperature range.

Among these operations in the preparation operation of the printing unit 20, the operation of circulating the inks takes the longest time; however, the time taken for the operation of circulating the inks is usually shorter than the time taken for the operation of heating the glue at the bookbinding unit 30 described above. The preparation operation of the printing unit 20 is controlled by the control section 28 of the printing unit 20.

The priority set in advance in the priority setting section 28*a* is set such that the removal of the cause of suspension at the bookbinding unit 30 is performed prior to the removal of the cause of suspension at the printing unit 20, with taking the time taken for the preparation operation of the bookbinding unit 30 and the time taken for the preparation operation of the printing unit 20, as described above, into account.

Then, the display control section 28*b* of the printing unit 20 references the priority set in the priority setting section 28*a* and causes the touch panel 27 to display a screen that prompts the user to remove the causes of suspension according to the priority. Specifically, the display control section 28*b* of this embodiment first causes the touch panel 27 to display a screen that prompts the user to remove the paper jam at the bookbinding unit 30. At this time, a message that prompts the user to remove the paper jam may be displayed, and a picture showing the location of the paper jam at the bookbinding unit 30 may also be displayed.

Then, as the paper jam is removed by the user seeing the display on the touch panel 27 of the bookbinding unit 30, the control section 51 of the bookbinding unit 30 starts the above-described preparation operation from that point of time.

On the other hand, as the paper jam at the bookbinding unit 30 is removed, the display control section 28*b* of the printing unit 20 next causes the touch panel 27 to display a screen that prompts the user to remove the cause of suspension at the printing unit 20.

At this time, a message that prompts the user to remove printing paper sheets left in the printing unit 20 may be displayed, and a picture showing the location of the printing paper sheets left in the printing unit 20 may also be displayed.

Then, as the printing paper sheets left in the printing unit 20 are removed by the user seeing the display on the touch panel 27, the control section 28 of the printing unit 20 starts the above-described preparation operation from that point of time. Then, as the preparation operations of both the units are completed, the control section 28 of the printing unit 20 and the control section 51 of the bookbinding unit 30 restart the normal operation from that point of time.

Figure 3:
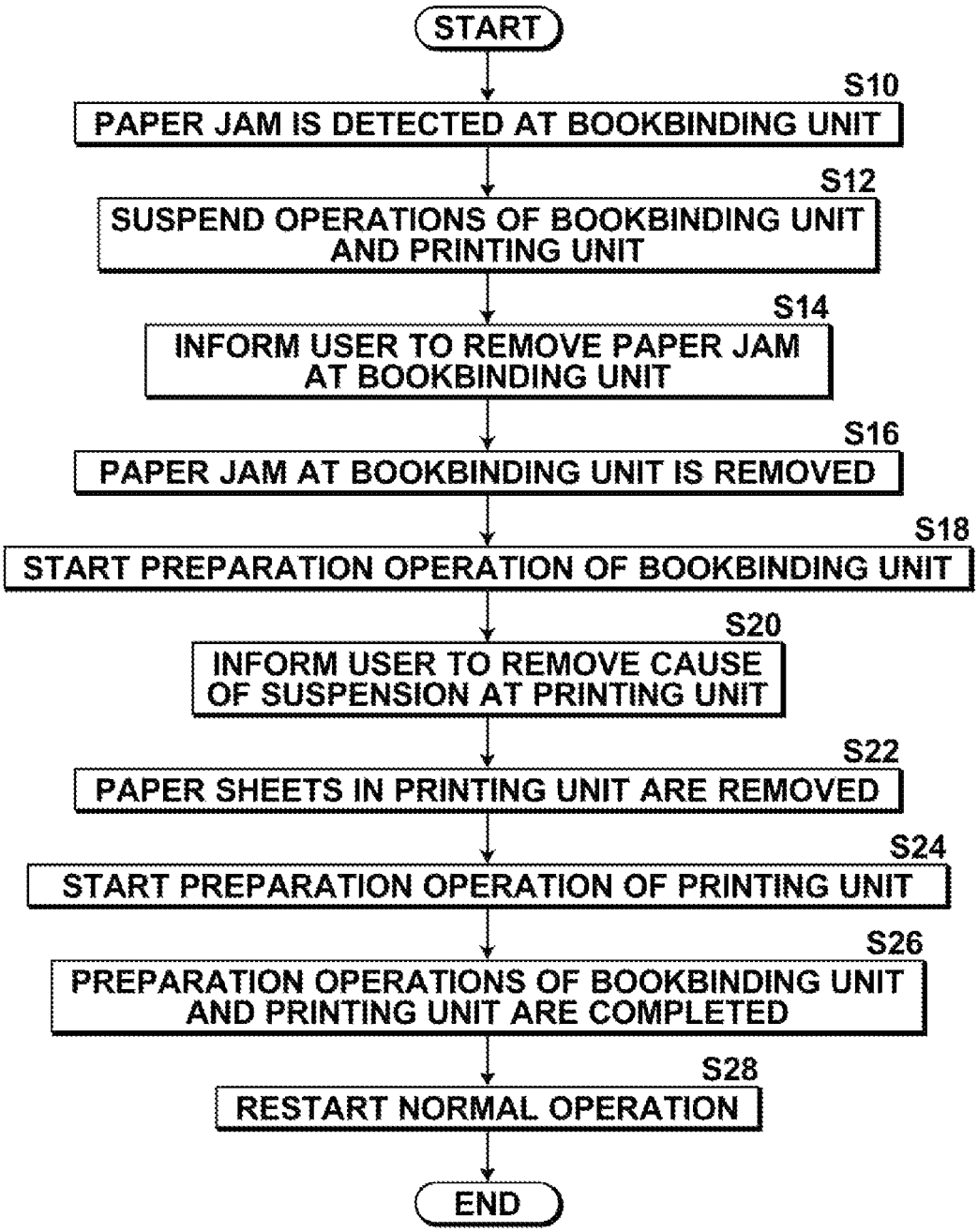
FIG. 3 is a flow chart for explaining operation of the printing system according to one embodiment of the invention.

Now, operation of the printing system 1 of this embodiment is described with reference to the flow chart shown in FIG. 3. Again, operation relating to the procedure of removal of causes of suspension at the printing unit 20 and the bookbinding unit 30 is mainly described.

First, if paper jam occurs at the bookbinding unit 30 while the printing operation is performed at the printing unit 20 and the binding operation is performed at the bookbinding unit 30, the occurrence of paper jam is detected by the paper jam detection section 50 of the bookbinding unit 30 (S10).

A detection signal of the paper jam detected by the paper jam detection section 50 is inputted to the control section 51 of the bookbinding unit 30. The control section 51 suspends the binding operation of the bookbinding unit 30 in response to the inputted detection signal, and outputs a signal to that effect to the control section 28 of the printing unit 20. Then, the control section 28 of the printing unit 20 suspends the printing operation, along with the suspension of the binding operation of the bookbinding unit 30 (S12).

Then, the display control section 28*b* of the printing unit 20 references the priority of removal of the cause of suspension set in the priority setting section 28*a*, and causes the touch panel 27 to display a screen that prompts the user to remove the causes of suspension based on the priority. Specifically, in this embodiment, first, a screen that prompts the user to remove the paper jam at the bookbinding unit 30 is displayed on the touch panel 27 (S14).

As the paper jam at the bookbinding unit 30 is removed by the user seeing the display on the touch panel 27 (S16), the removal of paper jam is detected by the paper jam detection section 50, and a detection signal of the removal of paper jam is inputted to the control section 51 of the bookbinding unit 30. Then, the control section 51 starts the preparation operation of the bookbinding unit 30 in response to the inputted detection signal (S18).

On the other hand, as the paper jam at the bookbinding unit 30 is removed, a signal to that effect is outputted from the control section 51 of the bookbinding unit 30 to the control section 28 of the printing unit 20. In response to the signal, the display control section 28*b* of the printing unit 20 causes the touch panel 27 to display a screen that prompts the user to remove the cause of suspension at the printing unit 20 (S20).

As the printing paper sheets left in the printing unit 20 are removed by the user seeing the display on the touch panel 27 (S22), the control section 28 of the printing unit 20 starts the preparation operation of the printing unit 20 from that point of time (S24).

When the preparation operation of each unit is completed, each of the control section 28 of the printing unit 20 and the control section 51 of the bookbinding unit 30 outputs a signal to that effect. When both the preparation operations are completed (S26), the control section 28 of the printing unit 20 and the control section 51 of the bookbinding unit 30 restart the normal operation from that point of time (S28).

According to the printing system 1 of the above-described embodiment, the priority of removal of the cause of suspension among the units is set in advance, and when the operations of the printing unit 20 and the bookbinding unit 30 are suspended due to paper jam, the user is informed to remove the causes of suspension according to the priority. This allows the user to remove the cause of suspension at each unit according to the priority, i.e., to remove the cause of suspension at the bookbinding unit 30, whose preparation operation takes a longer time than that of the printing unit 20, prior to removing the cause of suspension at the printing unit 20, thereby reducing the downtime of the system and improving the productivity.

It should be noted that the printing system 1 of the above-described embodiment may also include a paper jam detection section for detecting paper jam at the printing unit 20. In this case, when paper jam is detected at both the bookbinding unit 30 and the printing unit 20, the same operation as that described above is performed. However, when, for example, paper jam is detected only by the paper jam detection section at the printing unit 20, the operation of the bookbinding unit 30 is continued without being suspended. Then, in this case, the display control section 28*b* of the printing unit 20 causes the touch panel 27 to display a screen that prompts the user to remove the paper jam at the printing unit 20. As the paper jam is removed by the user, the preparation operation of the printing unit 20 is started from that point of time, and the normal operation is restarted when the preparation operation is completed.

Further, in the printing system 1 of the above-described embodiment, although the screen that prompts the user to remove the cause of suspension at the printing unit 20 is displayed after the screen that prompts the user to remove the cause of suspension at the bookbinding unit 30 is displayed so that the removal of the cause of suspension at the bookbinding unit 30 is performed prior to the removal of the cause of suspension at the printing unit 20, this is not intended to limit the invention. For example, the screen that prompts the user to remove the cause of suspension at the bookbinding unit 30 and the screen that prompts the user to remove the cause of suspension at the printing unit 20 may be provided with numbers indicating the priority and displayed simultaneously. Any other display method may be used, as long as the user is prompted to remove the cause of suspension at the bookbinding unit 30 prior to the cause of suspension at the printing unit 20.

As described above, among the operations in the preparation operation of the bookbinding unit 30, the operation of heating the glue takes the longest time. Among the operations in the preparation operation of the printing unit 20, the operation of circulating the inks takes the longest time. It is recognized that, usually, the operation of heating the glue takes a longer time than the operation of circulating the inks. Therefore, in the above-described embodiment, the removal of the cause of suspension at the bookbinding unit 30 is performed prior to the removal of the cause of suspension at the printing unit 20. However, depending on the glue temperature or the ink temperature when paper jam occurs at the bookbinding unit 30, for example, the operation of heating the glue may take a shorter time than the operation of circulating the inks. Therefore, the priority of removal of the cause of suspension between the printing unit 20 and the bookbinding unit 30 may be changed with taking the glue temperature and the ink temperature when paper jam occurs at the bookbinding unit 30 into account, for example.

Figures 4, 5:
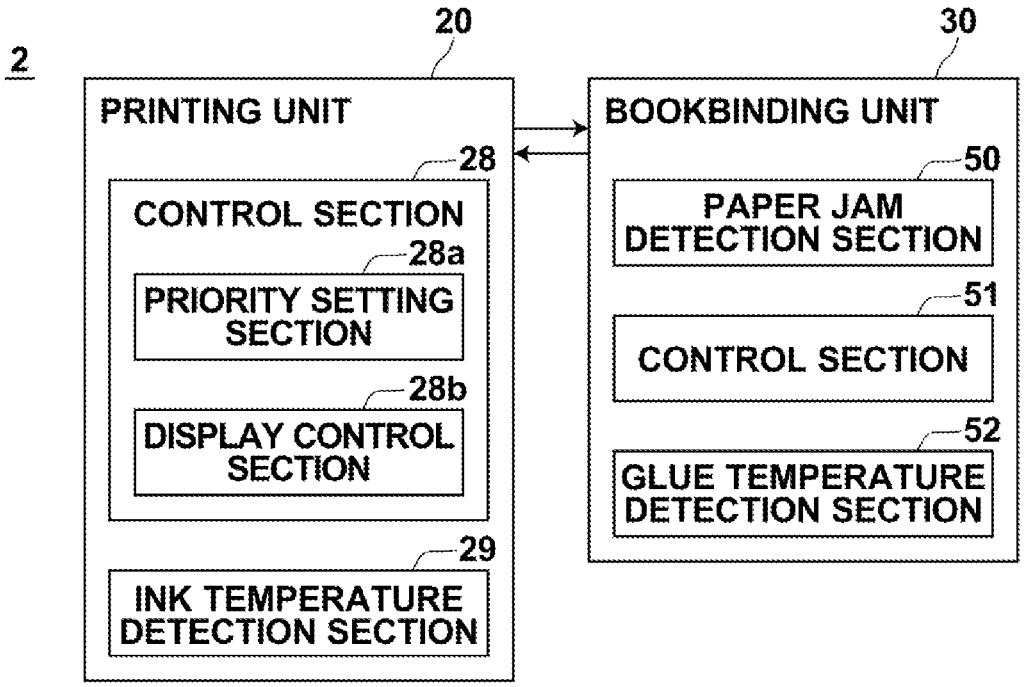
FIG. 4 is a block diagram illustrating the schematic configuration of a printing unit and a bookbinding unit of the printing system according to another embodiment of the invention.
FIG. 5 illustrates one example of a table associating ink temperature with time taken for preparation operation at "a", and one example of a table associating glue temperature with time taken for preparation operation at "b"

Specifically, a printing system 2 shown in FIG. 4 includes an ink temperature detection section 29 for detecting the ink temperature at the printing unit 20 and a glue temperature detection section 52 for detecting the glue temperature at the bookbinding unit 30.

Further, the control section 28 of the printing unit 20 includes a table that associates the ink temperature with the time taken for the preparation operation of the printing unit 20, as shown at "a" in FIG. 5, and the control section 51 of the bookbinding unit 30 includes a table that associates the glue temperature with the time taken for the preparation operation of the bookbinding unit 30, as shown at "b" in FIG. 5. It should be noted that the time taken for the preparation operation associated with the ink temperature and the time taken for the preparation operation associated with the glue temperature are measured in advance in experiments, or the like.

Then, when paper jam occurs at the bookbinding unit 30, the control section 51 of the bookbinding unit 30 obtains the glue temperature detected by the glue temperature detection section 52, and references the table shown at "b" in FIG. 5 based on the glue temperature to obtain the time taken for the preparation operation. Also, the control section 28 of the printing unit 20 obtains the ink temperature detected by the ink temperature detection section 29, and references the table shown at "a" in FIG. 5 based on the ink temperature to obtain the time taken for the preparation operation.

Then, the time taken for the preparation operation obtained by the control section 51 of the bookbinding unit 30 and the time taken for the preparation operation obtained by the control section 28 of the printing unit 20 are inputted to the priority setting section 28*a*. The priority setting section 28*a* compares the time taken for the preparation operation of the bookbinding unit 30 with the time taken for the preparation operation of the printing unit 20, which are inputted thereto. If the time taken for the preparation operation of the bookbinding unit 30 is longer than the time taken for the preparation operation of the printing unit 20, the priority setting section 28*a* sets the priority such that the removal of the cause of suspension at the bookbinding unit 30 is performed prior to the removal of the cause of suspension at the printing unit 20, as with the printing system 1 of the above-described embodiment.

In contrast, if the time taken for the preparation operation of the printing unit 20 is longer than the time taken for the preparation operation of the bookbinding unit 30, the priority setting section 28*a* sets the priority such that the removal of the cause of suspension at the printing unit 20 is performed prior to the removal of the cause of suspension at the bookbinding unit 30.

Then, as described above, the display control section 28*b* causes the touch panel 27 to display the screen that prompts the user to remove the cause of suspension at each unit so that the causes of suspension are removed according to the priority set by the priority setting section 28*a*.

Figure 6:
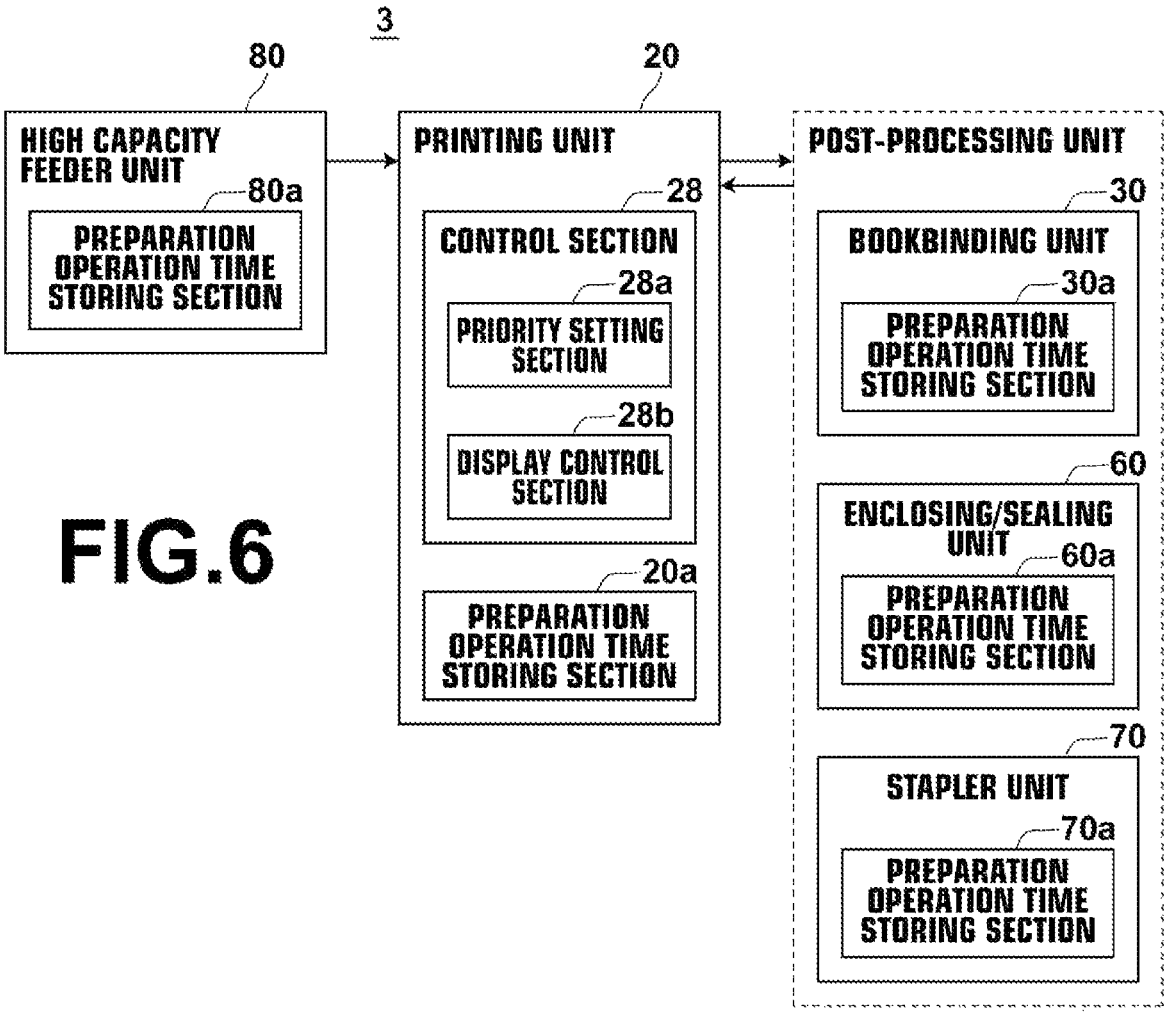
FIG. 6 is a block diagram illustrating the schematic configuration of a printing unit and a bookbinding unit of the printing system according to still another embodiment of the invention.

Although the printing systems 1 and 2 of the above-described embodiments relate to the procedure of removal of causes of suspension at the two units, the printing unit 20 and the bookbinding unit 30, this is not intended to limit the invention. The invention is also applicable to a printing system where a post-processing unit other than the bookbinding unit 30 is connected to the printing unit 20, or a pre-processing unit is connected to the upstream side of the printing unit 20. FIG. 6 shows one embodiment of a printing system having such a configuration.

A printing system 3 shown in FIG. 6 includes, besides the printing unit 20 and the bookbinding unit 30, a high capacity feeder unit 80, which is a pre-processing unit connected to the upstream side of the printing unit 20, and an enclosing/sealing unit 60 and a stapler unit 70, which are post-processing units. The bookbinding unit 30, the enclosing/sealing unit 60 and the stapler unit 70, which are the post-processing units, are selectively connected to the printing unit 20 such that any one of these post-processing units is connected to the printing unit 20.

The high capacity feeder unit 80 is capable of holding and feeding a larger amount of printing paper sheets than the amount of printing paper sheets that can be held in the printing unit 20. The enclosing/sealing unit 60 makes an envelope using a printing paper sheet for envelope subjected to printing at the printing unit 20, and encloses and seals in the envelope a printing paper sheet for inner sheet (letter) subjected to printing to form a sealed letter.

The stapler unit 70 staples a bundle of printing paper sheets ejected from the printing unit 20.

In the printing system 3 shown in FIG. 6, the printing unit 20 includes a preparation operation time storing section 20*a* for storing the time taken for the preparation operation of the printing unit 20, the bookbinding unit 30 includes a preparation operation time storing section 30*a* for storing the time taken for the preparation operation of the bookbinding unit 30, the enclosing/sealing unit 60 includes a preparation operation time storing section 60*a* for storing the time taken for preparation operation of the enclosing/sealing unit 60, the stapler unit 70 includes a preparation operation time storing section 70*a* for storing the time taken for preparation operation of the stapler unit 70, and the high capacity feeder unit 80 includes a preparation operation time storing section 80*a* for storing the time taken for preparation operation of the high capacity feeder unit 80.

The preparation operation of the enclosing/sealing unit 60 includes, for example: an operation of no-load running of rollers of the conveyance system for conveying the printing paper sheets; an operation of moving each actuator with a home position sensor to the home position thereof; and an operation of heating water at a hydration section, which wets a re-wetting glue area of a printing paper sheet for envelope. The preparation operations of the stapler unit 70 and the high capacity feeder unit 80 include, for example: an operation of no-load running of rollers of the conveyance system for conveying the printing paper sheets; and an operation of moving each actuator with a home position sensor to the home position thereof. The time taken for preparation operation stored in each storing section is measured in advance in an experiment, or the like.

When paper jam occurs, for example, at the post-processing unit (the bookbinding unit 30, the enclosing/sealing unit 60 or the stapler unit 70) in the printing system 3 having the above-described configuration, the operations of the printing unit 20, the high capacity feeder unit 80 and the post-processing unit are suspended.

At this time, the time taken for the preparation operation of the printing unit 20, the time taken for the preparation operation of the high capacity feeder unit 80, and the time taken for the preparation operation of the post-processing unit connected to the printing unit 20 are read out from the individual storing sections and inputted to the priority setting section 28*a* of the printing unit 20.

The priority setting section 28*a* compares the time taken for the preparation operation of the printing unit 20, the time taken for the preparation operation of the high capacity feeder unit 80 and the time taken for the preparation operation of the post-processing unit inputted thereto with each other, and sets the priority of removal of the cause of suspension among these units such that the causes of suspension at these units are removed in the order of the length of time taken for the preparation operation.

Then, as described above, the display control section 28*b* causes the touch panel 27 to display the screen that prompts the user to remove the cause of suspension at each unit so that the causes of suspension are removed according to the priority set by the priority setting section 28*a*.

Although the time taken for the preparation operation is stored in the storing section of each unit in the above-described printing system 3, the stored information may not necessarily be the time taken for the preparation operation, and other information which indicates the length of time taken for preparation operation may be stored in place of the time taken for the preparation operation.

According to the above-described printing system 3, the information about the time taken for the preparation operation of each unit, which is performed after the removal of the cause of suspension and before the restarting of the normal operation, is obtained, and the priority is set based on the obtained information. Therefore, even when there are two or more types of post-processing units and/or pre-processing units connected to the printing unit 20, for example, the preparation operations of the individual units can be started in an appropriate order by setting the priority based on the information about the time taken for the preparation operation of each unit.

Although the time taken for the preparation operation of each unit is measured in advance in an experiment, or the like, and stored in the printing system 3 shown in FIG. 6, this is not intended to limit the invention. The time taken for the preparation operation of each unit may be measured at the unit.

Figure 7:
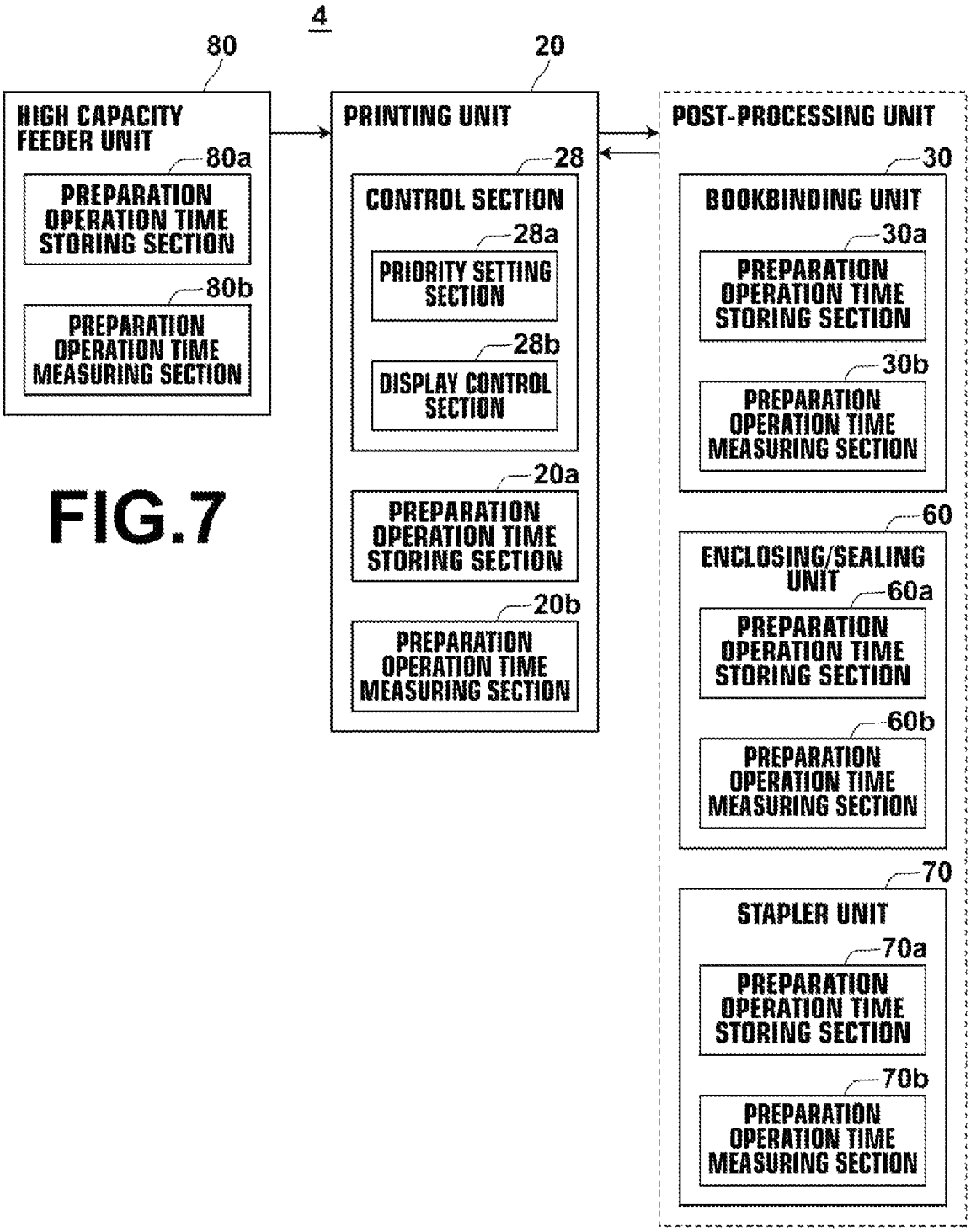
FIG. 7 is a block diagram illustrating the schematic configuration of a printing unit and a bookbinding unit of the printing system according to yet another embodiment of the invention.

Specifically, as shown in a printing system 4 shown in FIG. 7, each of the printing unit 20, the bookbinding unit 30, the enclosing/sealing unit 60, the stapler unit 70 and the high capacity feeder unit 80 may include a preparation operation time measuring section 20*b*, 30*b*, 60*b*, 70*b*, 80*b* for measuring the time taken for the preparation operation of the unit.

When, for example, each unit is powered on and the preparation operation of the unit is performed first time, the time taken for the preparation operation is measured by the preparation operation time measuring section 20*b*, 30*b*, 60*b*, 70*b*, 80*b* of the unit, and the measured time is stored in a preparation operation time storing section 20*a*, 30*a*, 60*a*, 70*a*, 80*a* of the unit. The measurement of the time taken for the preparation operation of each unit may be achieved by recognizing the start and the end of the preparation operation of the unit by obtaining control signals for controlling the above-described preparation operation of the unit by the preparation operation time measuring section. The following operations are the same as those of the above-described printing system 4 shown in FIG. 6.

According to the above-described printing system 4, the time taken for the preparation operation of each unit is actually measured at the unit, and the priority is set based on the measured time taken for the preparation operation of each unit. Therefore, even when a new pre-processing unit or post-processing unit is connected to the printing unit, for example, the time taken for the preparation operation of the unit can be obtained by actual measurement, and an appropriate priority can be set depending on the time taken for the preparation operation of the unit.

The priority set in advance in the priority setting section 28*a* may be set or changed according to input by the user via an input device (which corresponds to a priority settings receiving section), such as the touch panel 27. For example, even when the priority is set in advance such that the removal of the cause of suspension at the bookbinding unit 30 is performed prior to the removal of the cause of suspension at the printing unit 20, as described above, if the user thinks that it is better to remove the cause of suspension at the printing unit 20 prior to the cause of suspension at the bookbinding unit 30, the priority may be changed in such a manner.

As an example of the case where it is better to remove the cause of suspension at the printing unit 20 first, if the user wishes to use the printing unit 20 to print a document that teaches how to remove the cause of suspension at the bookbinding unit 30, the document can be printed before the cause of suspension at the bookbinding unit 30 is removed by removing the cause of suspension at the printing unit 20 first.

Further, although the post-processing unit is always included in the above-described printing systems 1 to 4, this is not intended to limit the invention, and the invention is also applicable to a printing system that is formed by a pre-processing unit, such as the high capacity feeder unit 80, and the printing unit 20.

What is claimed is:

1. A printing system comprising:

a printing unit for performing printing on printing paper sheets;

at least one of a post-processing unit for performing predetermined post-processing on printed printing paper sheets ejected from the printing unit and a pre-processing unit connected to the upstream side of the printing unit;

a priority setting section, in which a priority of removal of a cause of suspension among the units when operations of each unit are suspended due to a predetermined cause is set in advance; and an informing section for informing the user to remove the cause of suspension according to the priority set in the priority setting section.

2. The printing system as claimed in claim 1, wherein the printing system comprises the post-processing unit, and the priority set in the priority setting section is set such that the removal of the cause of suspension at the post-processing unit is performed prior to the removal of the cause of suspension at the printing unit.

3. The printing system as claimed in claim 1, wherein the priority setting section obtains information about a time taken for a preparation operation of each unit that is performed after the removal of the cause of suspension and before restarting of a normal operation, and sets the priority based on the obtained information.

4. The printing system as claimed in claim 3, further comprising a preparation operation time measuring section for measuring the time taken for the preparation operation of each unit, wherein the priority setting section obtains the time taken for the preparation operation of each unit measured by the preparation operation time measuring section and sets the priority based on the obtained time taken for the preparation operation.

5. The printing system as claimed in claim 1, further comprising a priority settings receiving section for receiving an input of settings of the priority by the user.

* * * * *